US006732886B2

(12) United States Patent
Cull

(10) Patent No.: US 6,732,886 B2
(45) Date of Patent: May 11, 2004

(54) OVER PRESSURE AUTOMATIC RELEASE MECHANISM FOR A CONTAINER HOUSING A PRESSURIZED MEDIUM

(76) Inventor: David J. Cull, 3N973 Wild Rose Rd., St. Charles, IL (US) 60174

( * ) Notice: Subject to any disclaimer, the term of this patent is extended or adjusted under 35 U.S.C. 154(b) by 19 days.

(21) Appl. No.: 10/057,106

(22) Filed: Oct. 25, 2001

(65) Prior Publication Data

US 2003/0080158 A1 May 1, 2003

(51) Int. Cl.[7] ..... B65D 83/70; F25D 3/08

(52) U.S. Cl. ..... 222/153.11; 222/397; 62/294

(58) Field of Search ..... 222/146.1, 146.2, 222/146.3, 146.6, 153.01, 153.02, 153.05, 153.06, 153.1, 153.11, 153.13, 153.14, 396, 397, 402.1, 402.13, 402.15; 62/294, 293, 60; 126/263.01, 262

(56) References Cited

U.S. PATENT DOCUMENTS 3,919,856 A 11/1975 Beck
5,348,199 A 9/1994 Smith
5,555,741 A 9/1996 Oakley
5,606,866 A 3/1997 Anthony et al.
5,692,391 A 12/1997 Joslin, Jr.

*Primary Examiner*—Gene Mancene
*Assistant Examiner*—Patrick Buechner
(74) *Attorney, Agent, or Firm*—Fulbright & Jaworski L.L.P.

(57) ABSTRACT

A container adapted to include a pressurized medium therein for purposes of dispensing the contents of the container or alternatively, to function as a heat exchange unit to heat or cool beverage or food contained therein. The container housing the pressurized medium includes an over pressure release mechanism which includes a barrier member disposed adjacent a valve stem which when depressed releases the pressurized medium. The valve including the moveable valve stem is carried by a mounting member at least that portion of which carries the valve is moveable outwardly responsive to the pressurized medium exceeding a predetermined pressure internally of the container. Upon such movement, the valve stem contacts the barrier which is stationary with respect thereto and after such contact, further moves the valve stem to activate the valve and release the pressurized medium contained within the container.

6 Claims, 4 Drawing Sheets

OVER PRESSURE AUTOMATIC RELEASE MECHANISM FOR A CONTAINER HOUSING A PRESSURIZED MEDIUM

FIELD OF THE INVENTION

This invention relates generally to containers housing a pressurized medium such as aerosol containers, self-chilling or self-heating food and beverage containers or the like and more specifically to an apparatus incorporated on such containers to automatically relieve pressure built up in the container upon such pressure reaching a predetermined level.

DESCRIPTION OF THE RELATED ART

The aerosol valve art and the self-chilling and self-heating food and beverage container art is quite extensive. A major problem with regard to containers particularly in these arts which house a pressurized medium utilized in dispensing the contents of the container or to heat or chill the contents of the container is that the pressure of the medium can under certain circumstances reach a level, if not controlled, which will cause the container to rupture and possibly even explode thereby imparting injury to users. Various attempts have been made with such prior art containers to relieve the pressure prior to serious rupture of the container or the explosion of the container.

Some of the attempts which have been made to relieve such pressure include permitting the concave bottom of the can to expand outwardly thus increasing the volume in the can. An additional over pressure relief mechanism used particularly in aerosol cans includes having the necked in portion of the can stretch to increase the volume. This will cause the valve cup which carries the dispensing valve to also move. If the over pressurized condition within the container increases sufficiently it causes the valve cup to move by an amount sufficient to cause the periphery thereof to release from the edge of the container thereby allowing the over pressure condition of the pressurized medium to be relieved, i.e., a total failure. In some instances, there is provided coining a portion of the bottom of such container to weaken a section thereof in such a manner that when the pressure internally of the container reaches a predetermined level the material forming the container around the coined area releases and the contents of the pressurized medium exit the container thereby relieving the over pressure condition therein.

The known problem of potential over pressurization is recognized in the art to the degree that all aerosol cans prior to their transport in interstate commerce must be subjected to a hot water bath for a predetermined period of time for the purpose of determining whether or not the pressurized medium within the container expands to a degree to cause the known over pressurization relief mechanisms of the type above described to become activated. If such does not occur then the aerosol container is deemed acceptable for shipment and use. The step of subjecting such aerosol containers to the hot water bath is an expensive and time consuming additional step required in the production of such devices.

There is therefore a need for a simple and inexpensive over pressure release mechanism for utilization upon a container housing a pressurized medium, such as an aerosol can, which will automatically release the pressure upon the pressure reaching a predetermined level which level is well prior to a rupture or explosion of the can.

SUMMARY OF THE INVENTION

An overpressure release mechanism adapted for use on a container housing a pressurized medium, said container including a valve member having a valve stem for releasing the pressurized medium upon activation, said valve member carried by a pedestal which is movable relative to said container upon pressure in said container reaching a predetermined level, means defining a barrier disposed adjacent said valve stem and anchored to said container, said valve stem engaging said barrier upon said pedestal moving responsive to said pressure reaching said predetermined level and activating said valve to relieve said over pressure condition.

In accordance with a more specific aspect, the present invention includes an over pressure release mechanism adapted for use on a container housing a pressurized medium which includes a valve having a movable stem adapted for releasing the pressurized medium which valve is carried upon a mounting member affixed to and closing an open end of the container, the mounting member including a pedestal upon which the valve is mounted and which pedestal moves responsive to the medium exceeding a predetermined pressure internally of the container, a panel member carried by said mounting member and overlying said stem; said panel member being movable only toward said stem; said stem engaging said panel member upon said pedestal moving outwardly responsive to said medium exceeding said determined pressure and thereafter moving said stem to release the pressurized medium from the container thereby relieving the over pressure condition therein.

BRIEF DESCRIPTION OF THE DRAWINGS

Various features of the invention will be apparent from the following specification and the accompanying drawings which schematically represent the invention but are not to be taken as a limitation with respect thereto.

DETAILED DESCRIPTION

Figure 1:
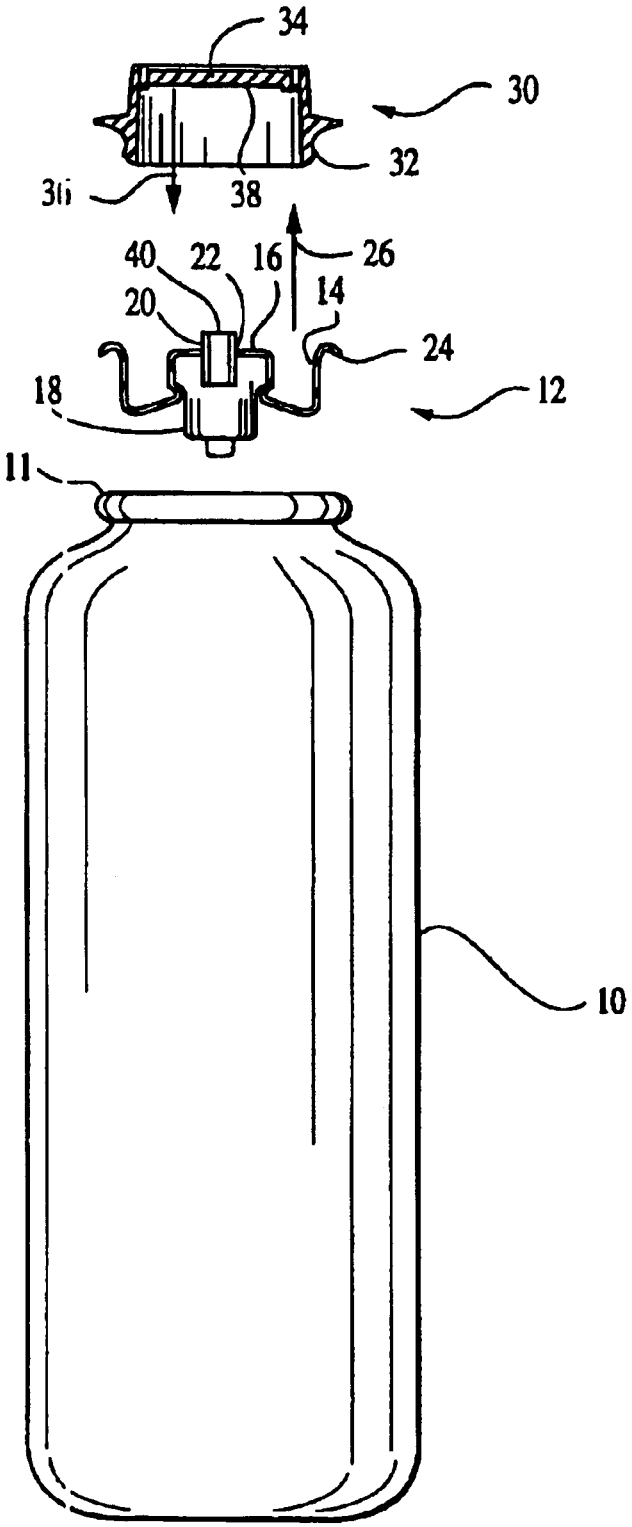
FIG. 1 is an exploded view of a container constructed in accordance with the principles of the present invention.

The present invention is directed to any type of container which houses a pressurized medium which may as a result of abuse or exposure to heat expand the medium and increase the pressure within the container to a point where it would no longer be safe to use. Such containers are used in many instances such for example as aerosol products of various types wherein the pressurized medium is utilized to dispense the product from the container and also in such units as containers which house a heat exchange unit internally thereof for heating or cooling beverage or food which may be contained within the container. In either event, the container or the heat exchange unit includes a valve member having a stem which is depressed in order to activate the device to dispense the contents of the container or to activate the heat exchange unit. The valve typically is carried upon a valve cup by way of a pedestal having a central opening through which the valve stem extends. It is well known in the prior art that if the contents of the container exceed a predetermined pressure then the pedestal of the valve cup will move outwardly.

For example in a standard aerosol container at 70° Fahrenheit the internal contents including the pressurized medium will be at approximately 70 to 90 psi pressure. When the pressure internally of the container reaches approximately 180 psi the pedestal will start to move. In a self-chilling/heating container of the type above referred to and particularly a self cooling beverage container utilizing a carbon-carbon dioxide adsorption-desorption cooling system the internal pressure is approximately at 250 psi and upon reaching approximately 300 psi internally of the container the pedestal carrying the valve will move approximately 0.015 inches. It has been determined in such devices that the normal working pressure is approximately 18 bar (approximately 270 psi). Even though the system is built to easily withstand well in excess of 20 bar (approximately 300 psi), it has been determined that to ensure that the unit will remain safe to use to the over pressure should be relieved by venting the contents of the can automatically at approximately 20 bar by utilizing the movement of the valve pedestal to accomplish this. This is done by placing a barrier member over the valve stem which will remain stationary relative to the valve stem such that as the pedestal moves outwardly the end of the valve stem will contact the barrier and thereafter the valve stem will be depressed sufficiently to commence release of the over pressure by venting the pressurized medium through the valve, and if such be the case, the product within the container.

Referring now more specifically to FIG. 1 there is illustrated an exploded view in schematic format of an apparatus constructed in accordance with the principles of the present invention. As is illustrated therein a container such as an aerosol can 10 is provided. The can 10 may have a product housed internally thereof such for example as hair spray, cleaning supplies, insect repellants, garden supplies, deodorants or a food or beverage product as is well known to those skilled in the art. Affixed to the upper open end 11 of the container 10 is a valve assembly 12. The valve assembly includes a mounting member 14 having a pedestal 16 within which there is sealingly secured a valve 18. The valve 18 includes a stem 20 extending through a central opening 22 in the pedestal 16. The mounting member 14 is inserted into the opening in the end 11 of the can 10 such that the outer periphery 24 thereof is affixed to the end 11 of the can 10 by way of a crimping operation as is well known to those skilled in the art. The crimping operation not only secures the valve assembly 12 to the can 10 but in addition closes and seals the open upper end 11 of the can 10. After such sealing, a pressurized medium such as nitrogen, carbon dioxide or, in those geographical areas where such is permitted, a hydroflourocarbon or a chloroflourocarbon or possibly even such a gas mixed with a liquified petroleum product will be inserted through the valve into the interior of the container 10 and used to dispense the product disposed within the container 10 by depressing the stem 20 of the valve assembly 12.

As above generally described as the pressurized medium contained internally of the can 10 expands as a result of the application of heat to the can 10 the pedestal 16 of the mounting member 14 will move upwardly as illustrated by the arrow 26 when the pressure internally of the container 10 reaches a predetermined amount which amount is determined by the application including the structure of the container 10 and the pressurized medium contained therein.

An actuator means 30 is adapted to be affixed to the upper portion of the assembled valve 12 and can 10 in such a manner that the body 32 of the actuator 30 will remain stationary relative to the pedestal 16. The actuator means 30 carries a barrier defining member 34 which may only be moved in a downward direction as shown by the arrow 36. That is, the barrier defining member 34 is designed in such a manner that it can never hinge upwardly as viewed in FIG. 1 even though forces may be applied to the lower surface 38 thereof. The means 30 is constructed in such a manner that when the body 32 thereof is secured internally of the mounting member 14 the surface 38 of the barrier member 34 will be positioned adjacent the end 40 of the stem 20 of the valve 18.

Figure 2:
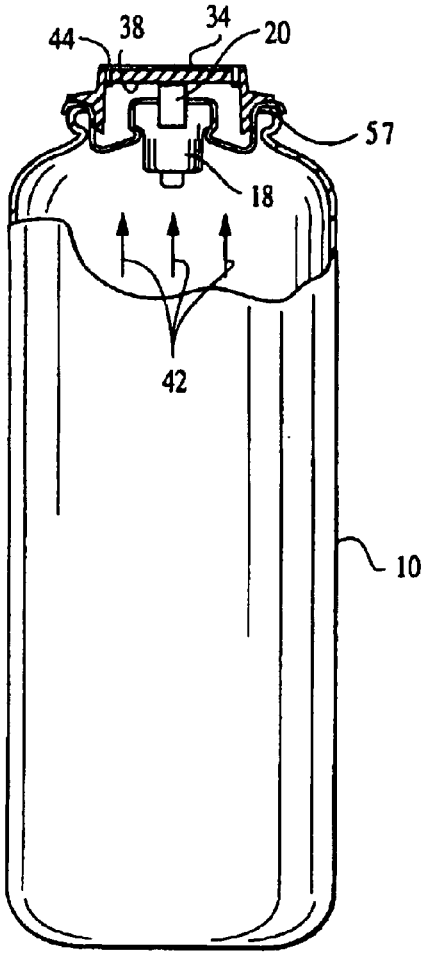
FIG. 2 is a schematic diagram illustrating the various parts shown in FIG. 2 in assembled form.

As will now become more apparent particularly by reference to FIG. 2 which illustrates the structure shown in exploded form in FIG. 1 in its assembled form, as the pressure within the can 10 increases as illustrated by the arrows 42 the pedestal 16 and the valve 18 carried by the pedestal will move upwardly such that the end 40 of the stem 20 will engage the lower surface 38 of the barrier defining member 34. As the pressure continues to increase within the interior of the can 10 the valve stem 20 will depress or move downwardly into the valve 18. This occurs because the barrier defining member 34 cannot move upwardly as viewed in FIG. 2 and when the valve stem 20 has been depressed sufficiently to open the valve 18 the pressurized medium contained within the interior of the can 10 will be allowed to vent through the valve 18 and escape into the atmosphere through openings provided in the member 30 such as is schematically shown at 44. As a result of this venting it will be impossible for the container 10 to have the pressure of the pressurized medium contained therein exceed the safe operating pressures of the device simply because the pressurized medium will always be automatically vented as above described.

Figure 4:
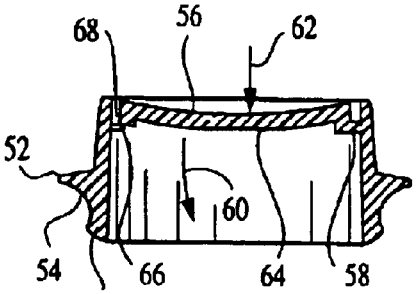
FIG. 4 is a cross sectional view of the actuator of FIG. 3 taken about the lines 4—4 thereof.
Figure 3:
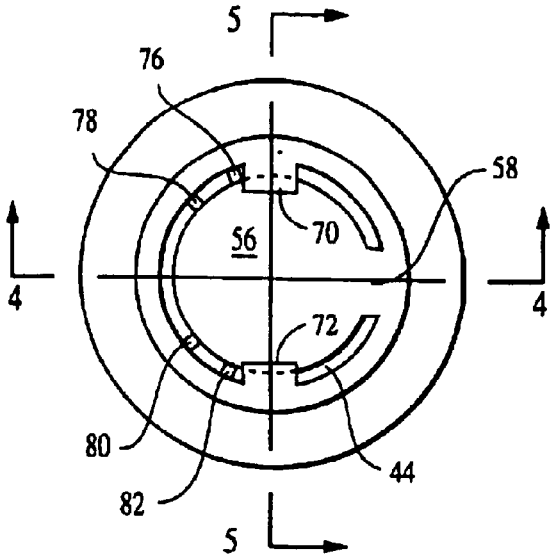
FIG. 3 is a top elevational view of an actuator assembly constructed in accordance with the principles of the present invention.
Figure 5:
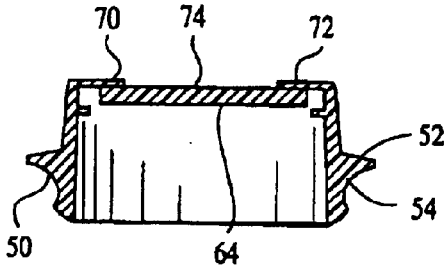
FIG. 5 is a cross sectional view of the actuator shown in FIG. 3 taken about the lines 5—5 thereof.

It should become apparent to those skilled in the art that the barrier forming means 30 may be constructed in a multitude of ways and may be adapted to function as may be required to actuate the valve 18 to dispense or release the contents of the container 10. As a result the means 30 may include a dispensing nozzle interconnected to the opening in the valve stem 20 or other such dispensing mechanism as may be needed according to the particular application. In addition the member 30 may be constructed of various types of materials as any particular application may dictate. Preferably the member 30 is an injection molded actuator constructed of a plastic material such as polypropylene, polyethylene or the like. One such device is illustrated in FIGS. 3 through 5 to which reference is hereby made. As is therein illustrated the member 30 is a valve actuator structure including a body 50 having an outwardly extending flange 52 forming a groove 54 which is adapted to receive the crimped top of the mounting member 14 and the top of the can 11 as is illustrated generally at 57 in FIG. 2. The flange 52 and groove 54 are designed such that the actuator 30 must be forcefully snapped into place over the valve assembly 12 once it is secured to the container 10. After the member 30 is snapped into place it becomes extremely difficult for it to be removed and it is effectively a permanent part of the overall structure and is stationary with respect to the mounting member 14. The actuator assembly includes a panel 56 which is integrally formed with and extends from the body 50 such that there is a hinge 58 which interconnects the panel to the body as is illustrated more clearly in FIG. 4. The hinge 58 allows the panel 56 to be depressed downwardly by the user, as shown by the arrow 60 in FIG. 4, to thereby depress the stem 20 to allow the pressurized medium to escape and if a product is contained within the container 10 to also permit it to be properly dispensed. Thus as is viewed in FIG. 4 when the consumer presses down on the panel 56 as is shown by the arrow 62 the lower surface 64 of the panel 56 will contact the upper end of the stem 20 depressing the same into the valve 18 thereby opening the valve and permitting the material contained within the container 10 to exit. As is also shown on FIG. 4 there may be included a latch mechanism 66 which when the panel 56 sufficiently depressed will engage a detent 68 to hold the panel 62 in an actuated position. Such a structure may or may not be desired but can easily be incorporated into the member as shown in the FIG. 4.

More importantly, the panel 56 is designed in such a manner that it can only rotate in the direction shown by the arrow 60. By reference now more specifically to FIGS. 3 and 5 it is there illustrated that locking members 70 and 72 extend inwardly from the body 50 to overly the top 74 of the panel 56 to preclude it hinging or moving upwardly as viewed in FIG. 4 or 5. Thus the lower surface 64 of the panel 56 cannot move upwardly away from the end 40 of the stem 20. Since the body 50 is rigidly affixed to the upper end of the can 10, the body and thus the lower surface 64 of the hinged panel 56 remains stationary with respect to the mounting member 14. Therefore, when the pressure internally of the container 10 as is shown by the arrows 42 in FIG. 2 increases to a level sufficient that the pedestal 16 commences to rise the end 40 of the stem 20 engages the surface 64 of the panel 56 thus functioning as a barrier to further upward movement of the stem. As the pedestal 20 continues to rise the stem 20 is depressed by the continued engagement thereof with the surface 64 until the stem 20 has been pushed into the valve 18 sufficiently to open the valve to allow the pressurized medium to vent to the atmosphere through the opening 44 as above described.

Figure 5A:
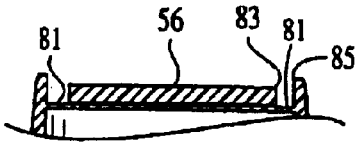
FIG. 5A is a partial cross sectional view illustrating an alternative embodiment of an actuator.

Alternatively, as opposed to having the overlying locking members 70 and 72 there may be provided a plurality of interconnecting frangible ribs or tabs such as shown at 76 through 82 which are formed as an integral part of the hinged panel 56 interconnecting it to the body 50 of the member 30. Through the utilization of such frangible rib members the hinged panel 56 is again constructed in such a way that it cannot hinge or move upwardly in response to the upward movement of the pedestal 16 as above described. However, these ribs 76 through 82 may be broken by the user pressing downwardly to depress the stem 20 and open the valve 18. Through utilization of these ribs 76 through 82 such may function as an indication of whether or not the device has been tampered with. A further alternative embodiment is shown in FIG. 5A wherein a thin frangible membrane 81 may be used to connect the edge 83 of the panel 56 to the inner edge 85 of the body 50. The membrane may be continuous or may be separated into two or more sections. The membrane 81 functions to hold the panel 56 in position as a barrier to the stem 20 to actuate the valve 18 when the container is subjected to over pressure. However, the membrane may be broken by the user pressing downwardly on the panel 56 to activate the valve 18. Again, the membrane 81, like the tabs 76–82 would serve as a tamper proof indicator.

Figure 6:
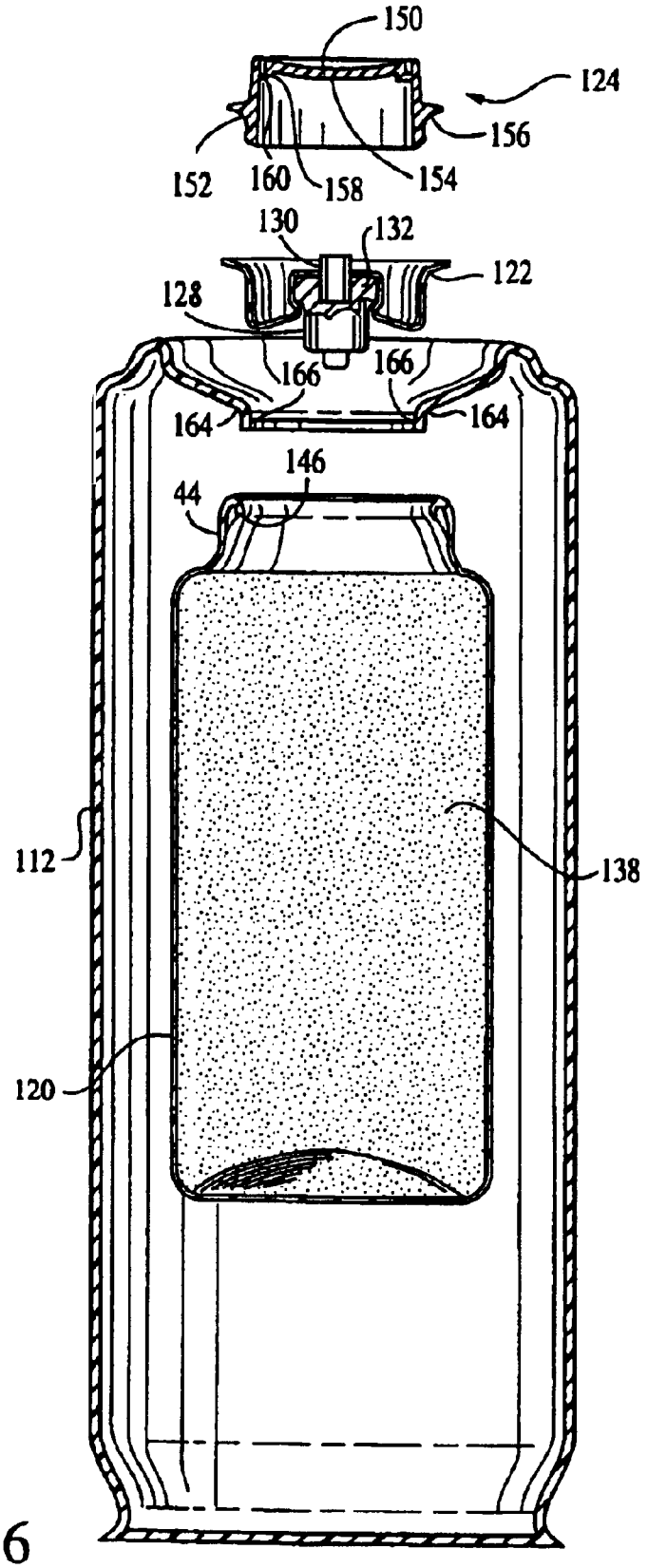
FIG. 6 is an exploded view of a self-chilling or heating food or beverage container constructed in accordance with the principles of the present invention.
Figure 7:
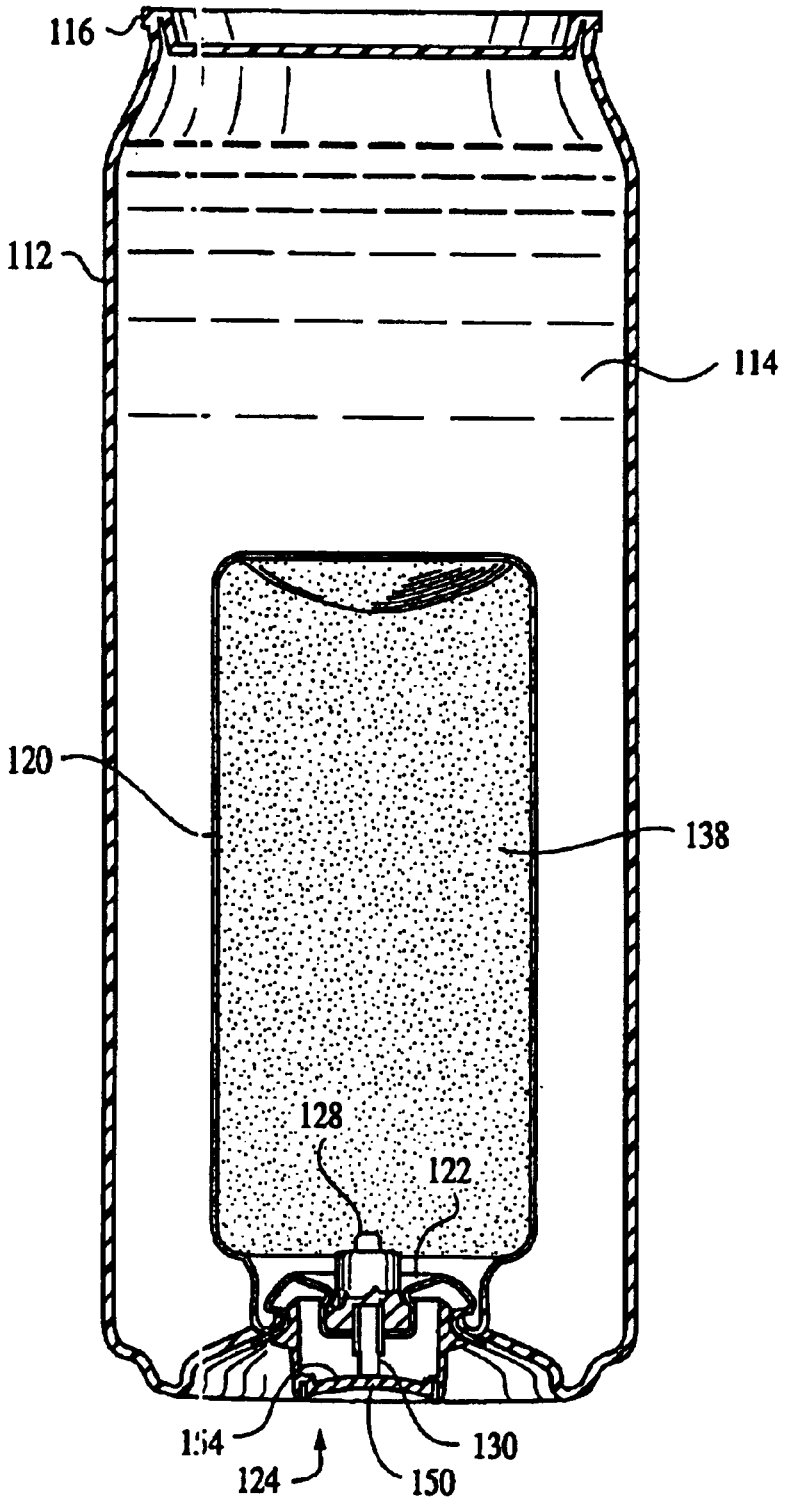
FIG. 7 illustrates the apparatus of FIG. 6 fully assembled.

As above indicated the present invention may also be utilized in conjunction with a heat exchange unit which is positioned internally of the container in order to heat or cool food or beverage contained therein upon activation of the valve to release the medium under pressure which is contained within the heat exchange unit. Such a structure is illustrated in FIGS. 6 and 7 to which reference is hereby made. As is therein shown there is provided a container 112 having a heat exchange unit 120 positioned therein. The heat exchange unit 120 preferably is filled with a matrix 138 of carbon particles. After assembly, the matrix 138 is charged with carbon dioxide which adsorbs onto the carbon to a pressure of approximately 250–270 psi. When the valve 128 is actuated, the carbon dioxide desorbs and is released to the atmosphere and cools the beverage 114 surrounding the heat exchange unit 120. A system utilizing a carbon-carbon dioxide adsorbent-desorbent refrigerant for cooling beverages is described in U.S. Pat. No. 5,692,381 which is incorporated herein by this reference.

A device for self heating food or beverage is illustrated and described in U.S. Pat. No. 5,626,022. As is therein shown, a heat exchange unit is supported internally of the container and when activated provides an exothermic reaction. The disclosure of U.S. Pat. No. 5,626,022 is incorporated herein by this reference. The upper end of the heat exchange unit is curled inwardly as shown at 146 to define the upper open end of the heat exchange unit 120. The heat exchange unit is the portion of the structure into which the pressurized medium is inserted. As is shown the upper closed end 164 of the container 112 has an opening provided therein and also has a downwardly turned flange 166 which encircles the opening. The upper end 146 of the container 120 is positioned such that the innersurface of the end 146 encircles the flange 166 and abuts the bottom 164 of the can. A valve cup 122 carrying a valve 128 having a stem 130 is also disposed internally of the opening and on the opposite side of the flange 166. As above indicated the elements are crimped together to form the completed assembly as is shown in FIG. 7. An actuator 124 is provided and contains the structure as above described including the flange 156 and the body 152 and the hinged panel 150 with the locking mechanism 158, 160 to hold the panel in position after it is depressed downwardly to move the stem 130 to open the valve 128 to allow the pressure medium contained within the heat exchange unit 120 to be vented to atmosphere to thereby cool the contents of the can 112. As above described the lower surface 154 of the hinged panel 150 defines a barrier to the top of the valve stem 130 so that when the pedestal 132 moves upwardly as a result of over pressurization of the contents of the heat exchange unit 120 the contents thereof may be vented to atmosphere.

The structure as above described is shown in assembled fashion in FIG. 7. As is illustrated in FIG. 7 the top of the valve stem 130 is positioned immediately adjacent the lower surface 154 of the hinged panel 150. Also the actuator 124 is securely and unremovably held in position by snap fitting the same so that the groove 152 firmly is seated against the curled portion of the upper part of the can and the valve cup after the same is crimped into position. After the HEU 120 is secured, the can 112 is filled with beverage 114 and the top 116 of the can is secured in place and contains the usual pull tab or the like (not shown) to open and provide access to the cooled beverage.

As will readily be understood by those skilled in the art there has thus been disclosed a structure in which a container such as an aerosol can having a pressurized medium contained therein is provided with a structure to release over pressure which may occur within the can by utilizing the upward movement of the pedestal carrying the valve so that the stem of the valve contacts a barrier as the pedestal rises thereby depressing the stem, opening the valve and immediately releasing the over pressure which has built up within the container thus maintaining the container safe under all conditions.

What is claimed is:

1. An over pressure release mechanism for a container housing a pressurized medium and having a valve member carried upon a valve mount and including a stem which, when depressed, releases said pressurized medium, said over pressure release mechanism comprising:

A) a barrier defining member disposed adjacent said stem;

B) a valve actuator having a body member fixedly secured to said container with a panel hinged to said body;

C) means for preventing said panel from moving away from said stem including locking members extending from said body and overlying said panel;

D) said valve mount including a pedestal for receiving said valve member, said pedestal being adapted to move toward said barrier defining member when said container is subjected to pressure exceeding a predetermined amount; and E) said stem being depressed after engagement with said barrier defining member by an amount to activate said valve and relieve the pressure within said container.

2. An over pressure release mechanism for a container housing a pressurized medium and having a valve member carried upon a valve mount and including a stem which, when depressed, releases said pressurized medium, said over pressure release mechanism comprising:

A) a barrier defining member disposed adjacent said stem;

B) a valve actuator having a body member fixedly secured to said container with a panel hinged to said body;

C) means for preventing said panel from moving away from said stem including a frangible membrane interconnecting said panel to said body;

D) said valve mount including a pedestal for receiving said valve member, said pedestal being adapted to move toward said barrier defining member when said container is subjected to pressure exceeding a predetermined amount; and E) said stem being depressed after engagement with said barrier defining member by an amount to activate said valve and relieve the pressure within said container.

3. A container housing a pressurized medium and having an over pressure release mechanism comprising:

A) a container having an open end and adapted for receiving a pressurized medium;

B) a valve having a movable stem member which upon being moved releases said pressurized medium from said container;

C) a mounting member carrying said valve and closing said open end of said container, at least that portion of said mounting member carrying said valve being outwardly movable responsive to said medium exceeding a predetermined pressure internally of said container;

D) an actuator comprising a molded plastic member having a body disposed on said container and having a movable panel hinged to said body and overlying said stem and movable only toward said stem to release said pressurized medium;

E) means for preventing said hinged panel from moving away from said stem including locking members extending from said body and overlying said panel; and F) said stem engaging said panel upon said valve moving outwardly responsive to said medium exceeding said predetermined pressure and thereafter moving said stem to release said pressurized medium from said container.

4. A container housing a pressurized medium and having an over pressure release mechanism comprising:

A) a container having an open end and adapted for receiving a pressurized medium;

B) a valve having a movable stem member which upon being moved releases said pressurized medium from said container;

C) a mounting member carrying said valve and closing said open end of said container, at least that portion of said mounting member carrying said valve being outwardly movable responsive to said medium exceeding a predetermined pressure internally of said container;

D) an actuator comprising a molded plastic member having a body disposed on said container and having a movable panel hinged to said body and overlying said stem and movable only toward said stem to release said pressurized medium;

E) means for preventing said hinged panel from moving away from said stem including a frangible membrane interconnecting said panel to said body; and F) said stem engaging said panel upon said valve moving outwardly responsive to said medium exceeding said predetermined pressure and thereafter moving said stem to release said pressurized medium from said container.

5. A container housing a food or beverage comprising:

A) a heat exchange unit including a first container having an open end and adapted for receiving a pressurized medium;

B) a valve having a movable stem member which upon being moved releases said pressurized medium from said first container;

C) a mounting member carrying said valve and closing said open end of said first container, at least that portion of said mounting member carrying said valve being outwardly movable responsive to said medium exceeding a predetermined pressure internally of said container;

D) an actuator comprising a molded plastic member having a body disposed on said first container and having a movable panel hinged to said body and overlying said stem and movable only toward said stem to release said pressurized medium;

E) means for preventing said hinged panel from moving away from said stem including locking members extending from said body and overlying said panel;

F) said stem engaging said panel upon said valve moving outwardly responsive to said medium exceeding said predetermined pressure and thereafter moving said stem to release said pressurized medium from said container;

G) a second container housing said food or beverage; and

H) means for attaching said heat exchange unit internally of said second container in contact with said food or beverage.

6. A container housing a food or beverage comprising:

A) a heat exchange unit including a first container having an open end and adapted for receiving a pressurized medium;

B) a valve having a movable stem member which upon being moved releases said pressurized medium from said first container;

C) a mounting member carrying said valve and closing said open end of said first container, at least that portion of said mounting member carrying said valve being outwardly movable responsive to said medium exceeding a predetermined pressure internally of said container;

D) an actuator comprising a molded plastic member having a body disposed on said first container and having a movable panel hinged to said body and overlying said stem and movable only toward said stem to release said pressurized medium;

E) means for preventing said hinged panel from moving away from said stem including a frangible membrane interconnecting said panel to said body;

F) said stem engaging said panel upon said valve moving outwardly responsive to said medium exceeding said predetermined pressure and thereafter moving said stem to release said pressurized medium from said container;

G) a second container housing said food or beverage; and

H) means for attaching said heat exchange unit internally of said second container in contact with said food or beverage.

* * * * *